US008851867B2

(12) United States Patent
Thomas

(10) Patent No.: US 8,851,867 B2
(45) Date of Patent: Oct. 7, 2014

(54) STATOR FOR PROGRESSIVE CAVITY PUMP/MOTOR

(75) Inventor: Gareth Thomas, Greater Manchester (GB)

(73) Assignee: National Oilwell Varco, L.P., Houston, TX (US)

( * ) Notice: Subject to any disclaimer, the term of this patent is extended or adjusted under 35 U.S.C. 154(b) by 142 days.

(21) Appl. No.: 13/702,091

(22) PCT Filed: May 3, 2011

(86) PCT No.: PCT/GB2011/050858

§ 371 (c)(1), (2), (4) Date: Dec. 5, 2012

(87) PCT Pub. No.: WO2011/158011

PCT Pub. Date: Dec. 22, 2011

(65) Prior Publication Data

US 2013/0084175 A1 Apr. 4, 2013

(30) Foreign Application Priority Data

Jun. 16, 2010 (GB) ..... 1010077.4

(51) Int. Cl.

| | |
|---|---|
| ***F01C 1/10*** | (2006.01) |
| ***B23P 15/00*** | (2006.01) |
| ***F04C 2/107*** | (2006.01) |
| ***F01D 9/02*** | (2006.01) |

(52) U.S. Cl.

CPC ..... *F01D 9/02* (2013.01); *F04C 2/1075* (2013.01); *F04C 2230/21* (2013.01)

USPC ..... 418/48; 29/888.023

(58) Field of Classification Search

CPC ..... F01D 9/02; F04C 2/1075; F04C 2230/21

USPC ..... 418/48; 415/208.1; 29/888.023, 428

See application file for complete search history.

(56) References Cited

U.S. PATENT DOCUMENTS

| | | | | |
|---|---|---|---|---|
| 4,265,323 | A * | 5/1981 | Juergens | 175/107 |
| 4,850,957 | A * | 7/1989 | Summers | 604/22 |
| 6,544,015 | B1 * | 4/2003 | Kaechele | 418/48 |
| 7,316,548 | B2 | 1/2008 | Jager | |
| 7,329,106 | B2 * | 2/2008 | Jager et al. | 418/48 |
| 7,407,372 | B2 | 8/2008 | Guidry et al. | |
| 7,942,906 | B2 * | 5/2011 | Bishop | 606/257 |

OTHER PUBLICATIONS

PCT/GB2011/050858 International Preliminary Report on Patentability Dated May 2, 2013 (12 p.).

GB Search Report dated Sep. 7, 2010; GB Application No. 1010077.4 (1 p.).

* cited by examiner

*Primary Examiner* — Hoang Nguyen

(74) *Attorney, Agent, or Firm* — Conley Rose, P.C.

(57) ABSTRACT

A stator for a progressive cavity pump or motor includes a stator housing and a stator thread made of a material moulded within the housing. The stator housing includes an outer tube and an inner anchor element within. The anchor element has radially disposed apertures and is spaced from outer tube. To fix the anchor element in the outer tube, the axial end faces of the anchor element each have a first set of protrusions and indentations around the circumference thereof. Two end caps of the housing are fixed at the end faces of the outer tube. Each end cap is provided with an interconnecting part having a second set of protrusions and indentations. The first and second sets of protrusions and indentations interengage to mechanically fix the anchor element axially and radially within the outer tube.

19 Claims, 3 Drawing Sheets

STATOR FOR PROGRESSIVE CAVITY PUMP/MOTOR

CROSS-REFERENCE TO RELATED APPLICATIONS

This application is a 35 U.S.C. §371 national stage application of PCT/GB2011/050858 filed May 3, 2011, which claims the benefit of British Patent Application No. 1010077.4 filed Jun. 16, 2010, both of which are incorporated herein by reference in their entireties for all purposes.

STATEMENT REGARDING FEDERALLY SPONSORED RESEARCH OR DEVELOPMENT

Not applicable.

BACKGROUND

1. Field of the Invention

The present invention relates to the construction of the stator of a progressive cavity pump or motor, and a method of assembly therefor.

2. Background of the Technology

Progressive Cavity (PC) pumps and motors have been used for years. The principle of operation of PC pumps was first described by Rene Moineau in his 1931 thesis and has since been known as the Moineau principle. Typically a PC pump or motor consists of a rigid helical rotor in a double-lead helical cavity stator. The differences in the leads between the rotor and the stator form cavities that progress axially from one end of the stator to the other as the rotor turns, moving the fluid through the pump or motor.

The stator is conventionally made of an elastomeric or plastic material thread housed into a typically metallic, rigid, sleeve-shaped outer tube. The helical profile of the stator thread is typically formed by injection moulding the elastomeric or plastic material into the outer tube around a core. During normal operation of a PC pump, the rotor operates in tight contact with the stator thread, generating a high torsional force between the rotor and the stator. Accordingly, a tight bond is required between the stator thread and the outer tube in order to obtain a torsionally rigid structure. Additionally, a tight bond is required in order to provide a fluid seal between the stator thread and the outer tube.

The stator thread may simply be moulded inside a bare tube and be attached to the outer tube by bonding it to the inside of the outer tube using adhesives. Bonding using an adhesive, however, limits the use of the stator to an operational temperature and chemical environment required by the adhesive. Operating conditions beyond the temperature and chemical environment required may lead to the breakdown of the bond causing the stator to detach from the outer tube.

It is well known, in many situations where rubber or elastomer is to be connected to a rigid body, to use not only bonding, whether by natural adhesion of the elastomer or by assisted adhesion with a chemical bonding agent, but also to provide a mechanical connection. This is potentially achieved by providing re-entrants in the body to which the elastomer is being connected to achieve a mechanical interlock. It is also achieved by providing a cage or the like fixed to the body by some means, and through which cage the elastomer is moulded, also achieving a mechanical interlock, albeit indirectly through the cage, with the body. Such re-entrants could be provided in the bore of the stator tube in the case of PC pumps and motors but, of course, providing such re-entrants is problematic. Indeed, the problem would be extreme with long stators such as employed in mud motors used in the oil industry that may call for stators of up to eight or more meters in length. Thus the provision of a cage or the like is more suitable. Recently, there have been several designs of stators that bond mechanically to the outer tube (thereby eliminating the need for an adhesive) and U.S. Pat. Nos. 7,407,372, 7,316,548 and 7,329,106 disclose different methods of mechanically bonding stator threads to inner perforated stator tubes that are connected by welding to the outer stator tube. The inner stator tubes incorporate radial apertures and are placed and welded to the outer tube prior to the injection moulding of the stator material.

Such stators are assembled by disposing an appropriate anchor element within the outer tube and permanently fixing the two together, typically using welded fixings at various locations along the length of tubes, prior to injection moulding the stator material. Furthermore, a fluid seal between the stator material and the outer stator tube is always necessary and, where no special adhesion is employed, another means is required of achieving it. In the patents just mentioned, this is, for example, achieved using sealing rings that compress the stator material following injection moulding. However, it is also suggested to form re-entrant grooves in the inner stator tube and sealing the elastomeric thread to the inner tube.

Manufacturing stators such as the ones described above, requires the use of complex manufacturing processes, customised for the production of each individual stator. Also, it is difficult, particularly in long tubes, to insert mechanical bonding tube cages inside stator tube housings and have them in any sort of a close fit, and so that they fit concentrically in the stator housing. Either they will snag on some inequality of the bore diameter of the housing and jam during insertion (this is a particular problem on longer stators) or they are too loose to form a stable bonding anchor for the stator thread material. It is an object of the present invention to provide an arrangement which addresses these issues. Indeed, it is an aim of embodiments of the invention to provide a stator that is simpler to manufacture.

BRIEF SUMMARY OF THE DISCLOSURE

According to a first aspect of the invention, there is provided a stator for a progressive cavity pump or motor, comprising a stator housing and a stator thread of a material moulded within the housing. The stator housing further comprises an outer tube, an inner anchor element disposed within and spaced from the outer tube and provided with radially disposed apertures receiving thread material therethrough. The axial end faces of the inner anchor element each have a first set of protrusions and indentations around a circumferential extent thereof. Two end caps are fixed at the end faces of the outer tube, each said end cap provided with an interconnecting part having a second set of protrusions and indentations along the circumference of the interconnecting part. The first and second sets of protrusions and indentations are interengaged to mechanically fix the inner anchor element axially and radially within the outer tube.

By providing sets of interengaging protrusions and indentations circumferentially around the end faces of the inner anchor element and end caps respectively, both radial and axial location of the respective components is assured, at least, it is assured if the respective protrusions and indentations are closely fitting with respect to one another in the circumferential direction. Indeed, this is the case even if all the engaging faces of the two components have no axial component. By that is meant that the engaging faces always include a line that is radial with respect to the stator outer tube. Put another way, the end faces are defined by axial and angular translation of a radius of the inner anchor element that cuts the inner anchor element, (which anchor element is intended to be concentric with the outer stator tube). Thus the inner anchor element has a circumferential extent that is circular and, when installed, is centred on the axis of the outer stator tube.

In certain embodiments, the inner anchor element comprises a plurality of axially disposed inner anchor element modules and wherein each end face of the inner anchor element modules comprise said first set of protrusions and indentations, whereby mutual interengagement of said first sets of protrusions and indentations mechanically fix adjoining modules.

By providing such modules, a stator of any length can be made using varying number of such modules. If each inner anchor element module is the same, this facilitates production by standardization of parts.

It is within the scope of the present invention that the inner anchor element is a tube. However, this is not desirable for reasons mentioned above regarding fit of such a tube in the outer stator tube housing. Moreover, apart from in its application with modules as mentioned above, the connection mechanism does not provide a great benefit. However, in certain embodiments of the present invention, the inner anchor element comprises a plurality of circumferentially disposed inner anchor element arcuate sections. That is, it is not a tube but a series of segments. Despite not forming a complete circle, such arcuate sections, by interengagement of the respective sets of protrusions and indentations nevertheless can form a rigid cage structure. Preferably there are two arcuate sections that form the inner anchor element.

Again, forming the inner anchor element of multiple components would be of no benefit if, when loosely assembled, edge to edge, they were still a tight fit in the bore of the outer tube. Thus, in certain embodiments, the inner anchor element comprises axially extending gaps between adjacent inner anchor element arcuate sections. This enables the arcuate sections to be assembled loosely together for insertion into the outer tube with a diameter sufficiently smaller than the internal diameter of the outer tube to facilitate sliding-in of the sections. However, once they engage the protrusions and indentations of the end cap, or the next module, they are obliged by the geometry to spread and adopt the radial position dictated by the actual radius of the section and potentially become a tight fit in the outer tube.

In certain embodiments, the protrusions and indentations comprise end surfaces that are circumferential in extent alternating with surfaces that are radial in extent. A transition, at least of the protrusions, between a circumferential face and an axial face, may be rounded with a large diameter so that a protrusion on one of the inner anchor element and an end cap, or another inner anchor element as the case may be, and an indentation on the other that are in the process of interengaging during assembly of the stator housing are led into one another by the transitions thus to facilitate that assembly.

Again, in certain embodiments, each inner anchor element arcuate section is the same, likewise facilitating and standardizing production. Indeed, the inner stator anchor elements are conveniently made from cast steel using sand moulds. Such cast elements have high rigidity and low flexibility, which is desirable given the function required of the anchor element in providing a firm base in the outer tube for the moulded stator thread to connect with. At the same time, however, such rigidity would be disadvantageous if the anchor was constructed as a tube, where some flexibility is necessary if a good fit is provided since there will be tight spots in the outer tube requiring some elastic deformation of the anchor on insertion, which deformation is not easily provided by cast material. With inner anchor element arcuate sections having defined gaps between them, however, not only is the insertion problem solved without loss of functionality (ie rigidity and concentricity) of the final stator housing, but also such cast products are inexpensive to manufacture.

In certain embodiments each of the end caps further comprises an annular recess formed into an inner surface of the end cap, whereby the stator thread material is retained by the annular recess. In certain embodiments the annular recess has an undercut profile, preferably a dovetail profile, and preferably being symmetrical across a radial plane. The dovetail recess enables a double seal to be provided on each inclined face of the dovetail. This assumes the normal shrinkage of the stator thread material as it solidifies so that the plug of material being pulled radially inwardly by the attempted shrinkage forms a tight abutment against such respective faces.

In certain embodiments, wherein each end cap is fixed to the outer tube via a welding seam.

In certain embodiments the inner anchor element has a series of circumferential ribs whose external diameter is the same as the internal diameter of the outer tube, said ribs abutting the outer tube and supporting the inner anchor element in the outer tube.

The invention also provides in another aspect a method of assembling a stator as defined above, the method comprising assembling said inner anchor element in the outer tube; disposing the end caps in the outer tube so as to interengage said first and second sets of protrusions and indentations to locate the inner anchor element in the outer tube fixing the end caps to the outer tube; disposing a mould core within the inner anchor element; injecting liquid stator material between the end caps and between the outer housing and core so that the material penetrates the apertures in the inner anchor element; and removing the core when the material has solidified.

When the inner anchor element comprises a plurality of circumferentially disposed inner anchor element arcuate sections, the step of assembling the inner anchor element in the outer tube may comprise arranging said arcuate sections into a tube and interengaging one of said first set of protrusions and indentations with the second set of said protrusions and indentations of one of said end caps to fix said arcuate sections into a tubular form.

When the inner anchor element comprises axially extending gaps between adjacent inner anchor element arcuate sections and, the inner anchor element has a series of circumferential ribs whose external diameter is the same as the internal diameter of the outer tube, said ribs supporting the inner anchor element in the outer tube, said gaps facilitate said step of assembling the inner anchor element in the outer tube by permitting radially inward disposition of the arcuate sections during insertion of the sections into the outer tube to reduce their insertion diameter.

In another aspect, the present invention provides an inner anchor element for the stator as defined above comprising a tubular body having radially disposed apertures and wherein the axial end faces of the inner anchor element each comprise said first set of protrusions and indentations along the circumference of the end face of the inner anchor element. While this arrangement is feasible (the inner anchor element comprising a tubular body) this is not ideal. It is preferred that the inner anchor element section comprises an arcuate section having radially disposed apertures and wherein the axial end faces of the section each comprise said first set of protrusions and indentations along the circumference of the end face of the inner anchor element.

In certain embodiments, the inner anchor element section has a series of circumferential circular ribs centred on an axis of the section, and wherein, when a plurality of said sections are assembled to form a tubular body with each circular rib centred on the same axis, a longitudinal gap extends between adjoining sections. Preferably, the inner anchor element (section or module or both) is cast from steel.

In another aspect, the present invention provides a stator for a progressive cavity pump or motor, comprising a stator housing and a stator thread of a material moulded within the housing. The stator housing further comprises, an outer tube, an inner anchor element disposed within the outer tube and provided with radially disposed apertures and two end caps fixed at the end faces of the outer tube to mechanically fix the inner anchor element axially and radially within the outer tube. Each end cap comprises a circumferential dovetail groove around an inner surface thereof in which a moulded end of the stator thread is retained and sealed to the end cap.

In certain embodiments, the end cap comprises a tubular body including said circumferential dovetail groove around an inner surface thereof. Preferably, the end cap is cast from steel.

Thus it is possible to manufacture stators of various lengths using standardised modular components.

BRIEF DESCRIPTION OF THE DRAWINGS

Embodiments of the invention are further described hereinafter with reference to the accompanying drawings, in which.

DETAILED DESCRIPTION

Figure 1:
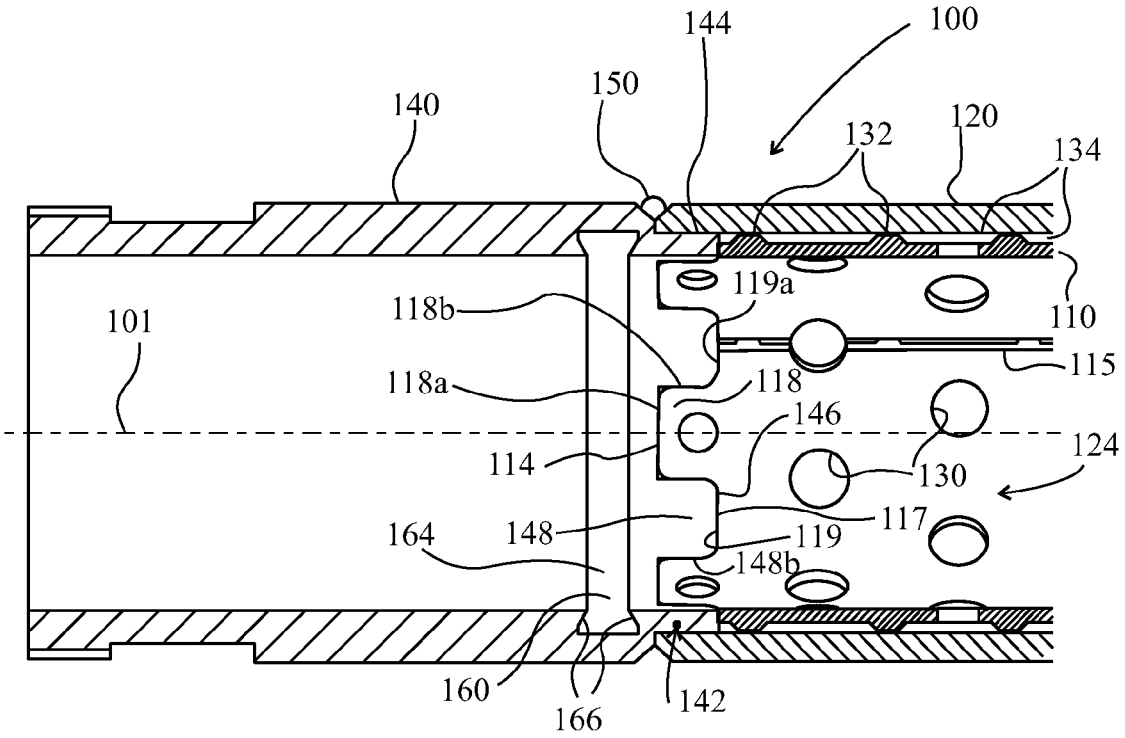
FIG. 1 shows a section through an end of a stator housing according to an embodiment of the invention.

FIG. 1 shows a part-assembled housing 100 for an elastomeric or plastic stator of a PC pump or motor according to an embodiment of the invention. The housing comprises a sleeve-shaped outer tube 120, an inner anchor element 110 spaced radially within the outer tube 120 and a pair of hollow, cylindrical end caps 140 (only one of which is visible in FIG. 1) axially disposed at the end faces of the outer tube 120 and anchor element 110. The housing 100 has a longitudinal axis 101.

The inner anchor element 110 includes a plurality of apertures 130 that are spaced along the inner anchor element 110. The radially outermost surface of the inner anchor element 110 has circumferential ribs 132, whose diameter is substantially equal to the inner surface diameter of the outer tube 120, and such that the outermost surface of the inner element 110 and the inner surface of the outer tube 120 are in contact. However, between the ribs 132 are formed annular spaces 134 between the inner and outer tubes 110,120.

The stator thread is not shown in the drawings. It is generally formed by moulding. After assembly of the housing 100, a mould core with a double, or more, helical thread form (not shown) is inserted in a known manner in a bore 124 of the housing 100 defined by the tube 120. Elastomeric material is injected in the annular space between the core and housing 100 so that the elastomeric material penetrates the apertures 130 to surround the inner anchor element 110 and extend into the annular gaps 134. In this way a mechanical bond is provided between the stator thread material and the inner anchor element 110. When the elastomeric or plastic stator material has been injected into the housing 100, the inner anchor element 110 is embedded in the stator material. The stator material also extends to the inner surface of the outer tube 120.

An interconnecting part 142 is part of the end cap 140 and extends into the outer tube 120. The diameter of the radially outer surface 144 of the interconnecting part 142 is substantially equal to the inner surface of the outer tube 120 such that, when the interconnecting part 142 of the end cap 140 is disposed within the end face of the outer tube 120, the radially outer surface of the interconnecting part 142 is substantially in contact with the inner surface of the outer tube 120. The end cap 140 may be bonded to the outer tube 120 via a welding seam 150. However, other means of fixation are not excluded. In certain embodiments the end caps 140 may be bonded to the outer tube 120 via a mechanical press-fit connection or other mechanical means.

Figure 1A:
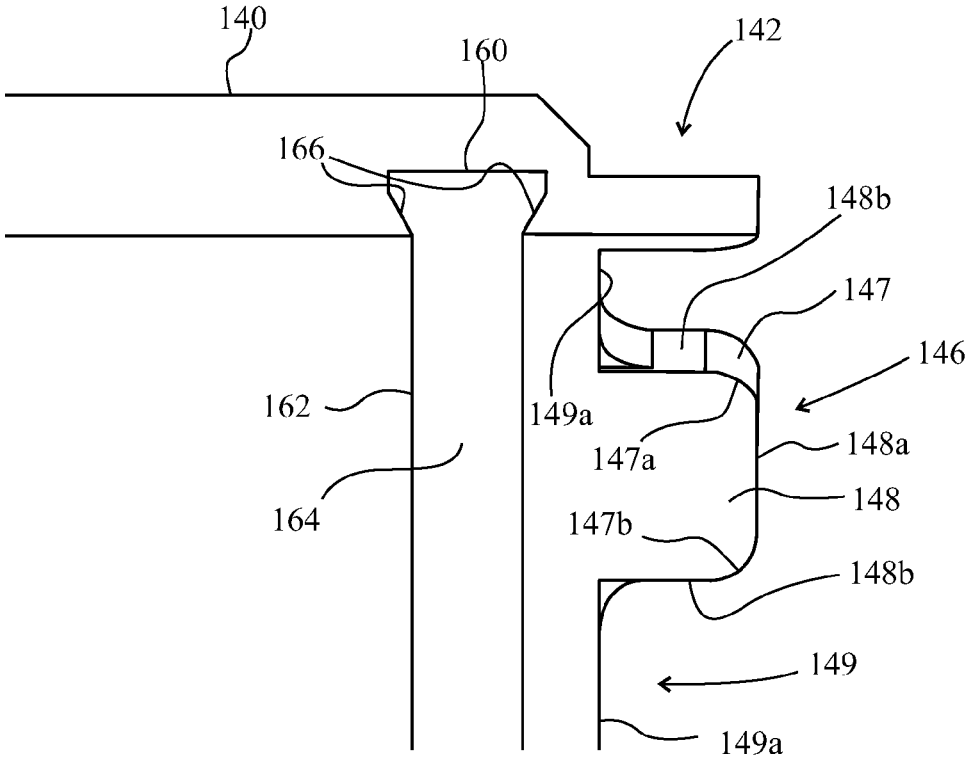
FIG. 1*a* shows a detail of the end cap in FIG. 1.

The end face 146 of the interconnecting part 142 (see also FIG. 1*a*) of the end cap, and the axial end face 114 of the anchor element 110 each comprise matching interlocking sets, along their respective circumferences, of protrusions 148,118 and indentations 149,119 that extend in an axial direction with respect to axis 101. Coupling the two end-faces together interlocks the matching patterns and provides a mechanical bond between the end cap 140 and the anchor element 110. A bond is made because the respective outer and inner surfaces 147,117 of the protrusions 148 and indentations 119 are all parallel a radius of the axis 101 that intersects the surface. Consequently, when interengaged, no movement is possible between them except in an axial direction. Thus, when two end caps 140 clamp between them an anchor element 110, where between each end cap and the anchor element such interengaging sets of protrusions and indentations are arranged, the anchor element is fixed against axial, radial or angular movement with respect to the outer tube 120. This is of course provided that the protrusions of one element are a close sliding fit in the opposing indentations of the other element.

It is to be understood that the two axially opposite end faces of the anchor element 110 are preferably the same and the two axially opposite end faces of the outer tube 120 are also preferably the same.

During the assembly of the housing 100, anchor element 110 is disposed within outer tube 120. Two end caps 140 are then disposed at the axially opposite ends of the part assembled housing 100. The interconnecting parts 142 couple to either end of the anchor element 110. This assembly is facilitated if the transitions between a protrusion and indentation (ie corners 147*a,b*—see FIG. 1*a*) are rounded so that, when approximate engagement is achieved through almost the correct angular orientation of the end cap 140 with respect to anchor element 110, the rounded corners 147*a,b* lead the protrusions into engagement with the indentations. In that respect, it is to be noted that the protrusions 148,118 and indentations 149,119 are each provided with end faces 148*a*, 118*a* and 149*a*, 119*a*, respectively, that are circumferential alternating, with protrusions 148, 118 having axially extending and circumferentially opposed lateral surfaces 148*b*, 118*b*. However, such a castellated structure is not essential and a saw-tooth arrangement (not shown) would be equally practical.

This assembly thus fixes the anchor element 110 within the outer tube 120. The stator material can then be injection moulded into the housing 100. The stator material is forced radially outward by pressure through the apertures 130 of the anchor element 110. Typically, upon cooling, the injected stator material shrinks radially inwards. To prevent the moulded sleeve separating from the housing 100, the end cap 140 may further comprise an annular recess 160. The cavity formed by the recess 160 has a dovetail profile. The opening 162 at the surface of the recess (along the inner surface of the end cap) is smaller than the base 164 of the recess. The dovetail recess 160 of the end cap 140 is designed to act as a retention device of the stator material. During moulding, the elastomer penetrates into the annular recess 160 of the end caps 140. By providing a dovetail recess 160, two narrowing sealing faces 166 are provided that prevent the stator material from slipping out.

Figure 2A:
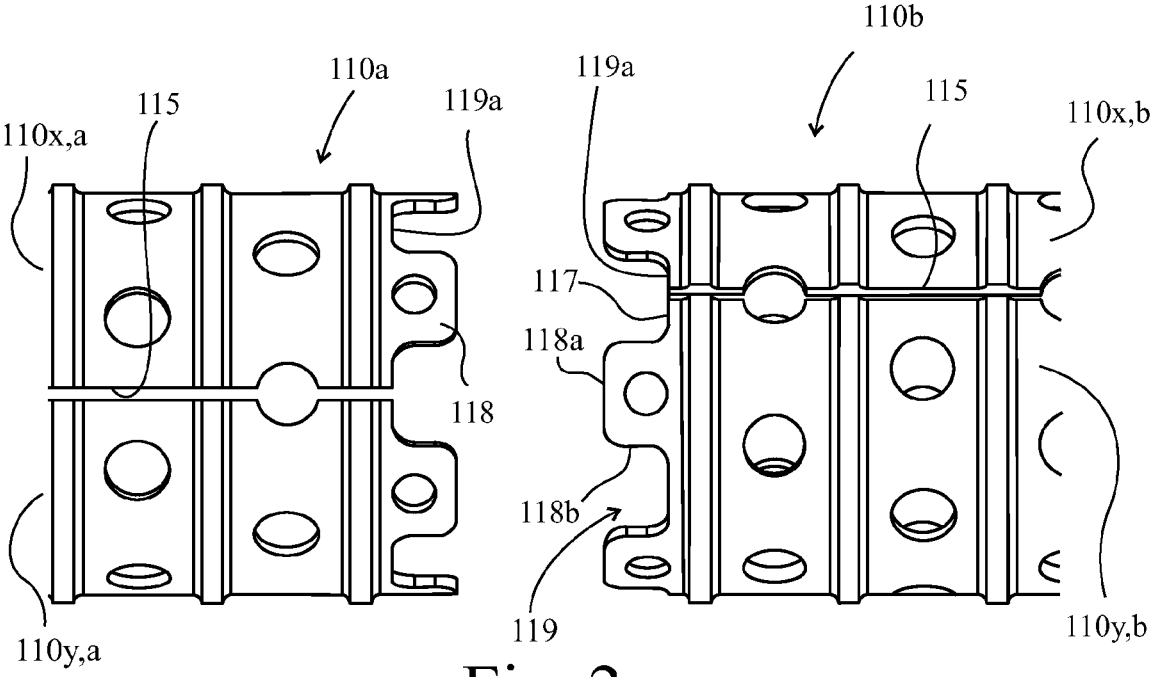
FIGS. 2*a* and *b* show in side view a) the ends of inner anchor elements according to an embodiment of the invention and b) the coupling of the inner anchor elements shown in FIG. 2*a;*
Figure 2B:
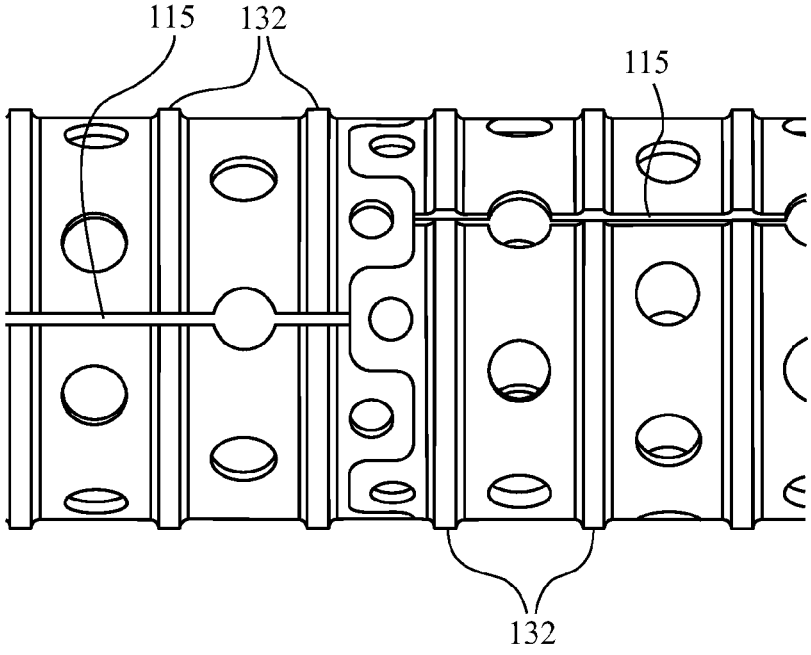

FIGS. 2*a* and *b* shows two anchor elements 110*a*, 110*b* and, in FIG. 2*b* they are coupled together through their respective protrusions 118 and indentations 119. The coupling provides the possibility of a mechanical bond between any number of anchor elements 110. It is to be understood that a housing 100 of length L1, may be assembled using a single inner anchor element 110 of length L2. Alternatively, it may be assembled in a modular way using a plurality of preferably identical inner anchor elements 110*a,b* that, when coupled, provide for a substantially similar structure to the inner anchor element 110 of length L2. Accordingly, in certain embodiments, a stator housing can be assembled using a plurality of axially disposed anchor elements. This enables stators of various lengths to be manufactured using standardized anchor elements arranged modularly.

While the stator anchor element 110 may be formed as tubes having a complete circumference, an aspect of the present invention is the possibility to form each element 110, or each modular element 110*a,b*, from arcuate sections 110*x,y*, each preferably occupying the same sector angle, and, indeed, being substantially the same. While any sector angle that is approximately a factor of 360 degrees is possible, preferably each is almost 180 degrees of sector, so that two arranged side by side there is an axial gap 115 between them.

Figure 3B:
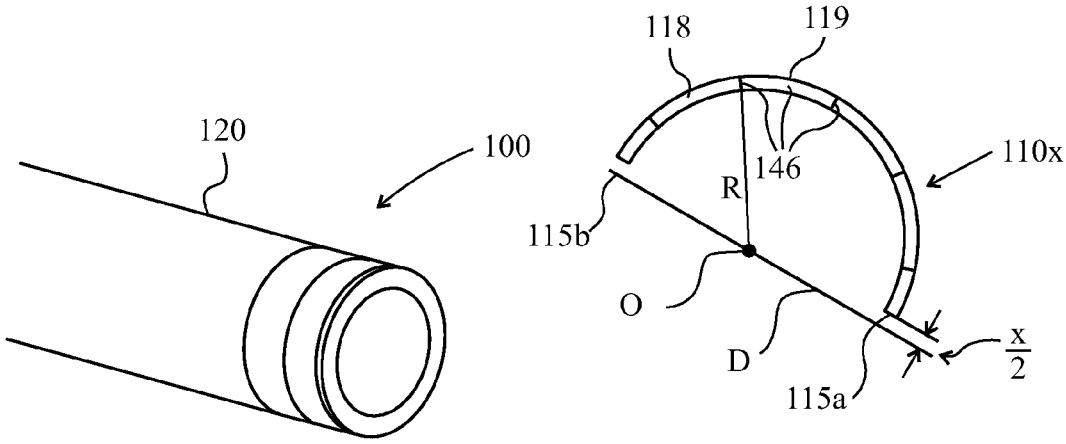
FIG. 3*b* shows an end view of an inner stator section.
Figure 3A:
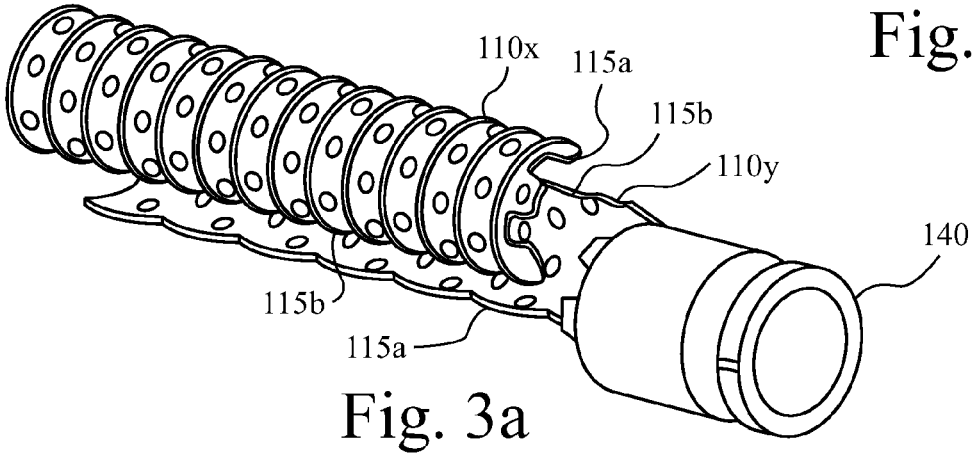
FIG. 3*a* shows in perspective view components of a stator housing according to an embodiment of the invention.

FIG.3*a* is an expanded view of the components of a housing 100 for a stator of a PC pump or motor according to the invention. The housing comprises outer tube 120 and anchor element sections 110*x,y*, and end cap 140. Turning back to FIGS. 2*a,b*, it is to be noted that when inner anchor element section modules 110*x,a*, 100*y,a* are to be connected to adjoining inner anchor element section modules 110*x,b*, 110*y,b*, one section module bridges the gap 115 between adjoining section modules. This further serves to anchor the elements together.

Figure 4:
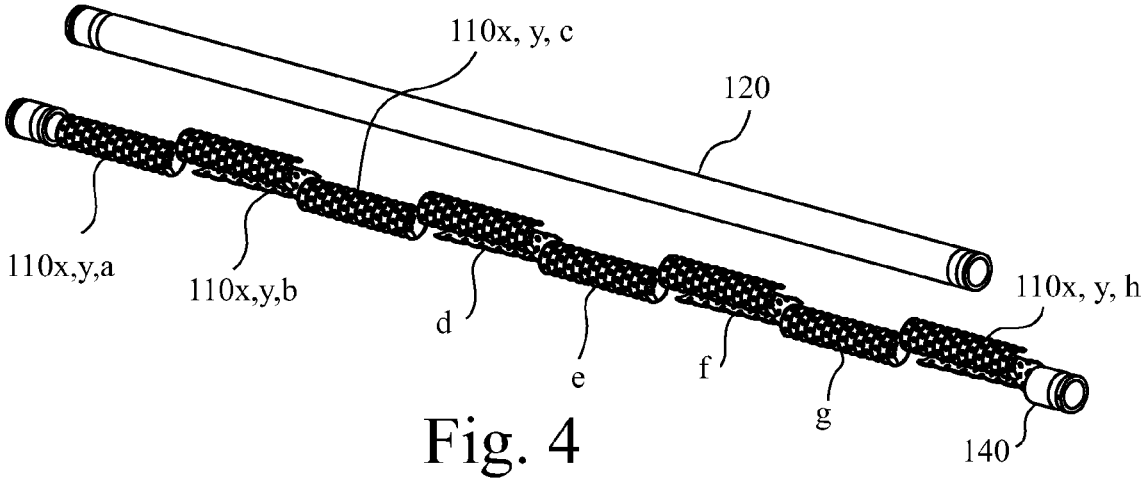
FIG. 4 shows multiple components of a stator housing according to an embodiment of the invention.

FIG. 4 is an expanded view of the components of the housing 100 comprising eight axially disposed inner anchor element section/modules 110*x,y,a-h* (110*x,y,d-g* being labeled d-g). The fact that the sectors form an angle of less than 180 degrees (or less than 120 degrees if there are three of them, or 90 degrees if four) means that, when the housing 100 is being assembled, the long sides 115*a,b* of adjoining sections 110*x,y* can be married together so that they are abutting. In this condition, all radial dimensions of the loosely assembled sections are less than the internal diameter of the outer tube 120. Accordingly, the sections can be inserted with relative ease. However, when the sets of protrusions and indentations 118,119 of one set of adjoining sections are attempted to butt up with and engage the set of protrusions and indentations 118,119 of the next set of sections (or the connecting part 142 of an end cap 140) then to effect such engagement, the sections must adopt same circumferential position. Otherwise such interengagement cannot be effected.

FIG. 3*b* is an end view of a section 110*x*, whose radius of curvature is R and whose circumferential extent is ($\pi$R-x), where x is the width of the gap 115. A diameter D of the circle of radius R centred on O, the centre of curvature of the section 110*x*, does not cut the sections 110*x* and leaves a gap of x/2 on each side. Furthermore, the end faces 118*a*, 119*a* of the respective protrusions and indentations 118,119 are all radial with respect to O. That is to say, there is a line lying in the surface 146 at any location that is radial with respect to O.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A stator for a progressive cavity pump or motor, comprising:

a stator housing; and a stator thread moulded within the housing, wherein the stator housing has a central axis and further comprises:

an outer tube having a first end and a second end opposite the first end;

an inner anchor element disposed within the outer tube and including a plurality of apertures extending radially therethrough, wherein the apertures provide access to one or more gaps radially disposed between the inner anchor element and the outer tube, wherein the stator thread extends through the apertures into the one or more gaps, and wherein a first end and a second end of the inner anchor element each comprise a first plurality circumferentially-spaced protrusions and a plurality of circumferentially-spaced indentations, one indentation being circumferentially disposed between each pair of circumferentially-adjacent protrusions of the inner anchor element; and a first end cap fixed to the first end of the outer tube;

a second end cap fixed to the second end of the outer tube;

wherein each end cap includes an interconnecting part having a second plurality of circumferentially-spaced protrusions and a plurality of circumferentially-spaced indentations, one indentation being circumferentially disposed between each pair of circumferentially-adjacent protrusions of each end cap;

wherein the first plurality of protrusions at the first end of the inner anchor housing engage the plurality of indentations of the first end cap and the first plurality of protrusions at the second end of the inner anchor housing engage the plurality of indentations of the second end cap.

2. The stator of claim 1, wherein the inner anchor element comprises a plurality of inner anchor element modules coupled together end-to-end, and wherein an end of each inner anchor module includes a plurality of protrusions and indentations that engage the protrusions and indentations of the adjacent inner anchor element module.

3. The stator of claim 2, wherein each inner anchor element module is the same.

4. The stator of claim 1, wherein the inner anchor element comprises a plurality of circumferentially adjacent inner anchor element arcuate sections.

5. The stator of claim 4, wherein the inner anchor element comprises axially extending gaps between circumferentially-adjacent inner anchor element arcuate sections.

6. The stator of claim 4, wherein each inner anchor element arcuate section is the same.

7. The stator of claim 1, wherein each end cap further comprises an annular recess disposed on an inner surface of the end cap, whereby the stator thread is disposed in the annular recess.

8. The stator of claim 7, wherein the annular recess has an undercut profile.

9. The stator of claim 1, wherein each end cap is fixed to the outer tube with a welding seam.

10. The stator of claim 1, wherein the inner anchor element has an outer surface comprising a plurality of axially-spaced annular ribs that engage the outer tube.

11. A method for assembling a stator the method comprising:

positioning an inner anchor element within an outer tube;

engaging a plurality of indentations at a first of the inner anchor element with a plurality of projections at an end of a first end cap;

engaging a plurality of indentations at a second end of the inner anchor element with a plurality of projections at an end of a second end cap;

securing the first end cap to a first end of the outer tube;

securing the second end cap to a second end of the outer tube;

disposing a mould core within the inner anchor element;

injecting liquid stator material between the end caps and between the outer housing and core;

allowing the liquid stator material to pass radially through a plurality of apertures in the inner anchor element and into one or more gaps radially disposed between the inner anchor element and the outer tube; and removing the core after the liquid stator material has solidified.

12. The method of claim 11, wherein the inner anchor element comprises a plurality of circumferentially adjacent inner anchor element arcuate sections, wherein positioning the inner anchor element within the outer tube comprises arranging said arcuate sections into a tube.

13. The method of claim 12, wherein an axially extending is disposed between the circumferentially-adjacent inner anchor element arcuate sections; and, wherein the inner anchor element has an outer surface comprising a plurality of axially spaced annular ribs that engage the outer tube;

wherein said gaps facilitate the positioning of the inner anchor element in the outer tube by permitting radially inward disposition of the arcuate sections during insertion of the inner anchor element arcuate sections into the outer tube to reduce their insertion diameter.

14. A stator for a progressive cavity pump or motor, the stator comprising:

an outer tube;

an inner anchor element disposed within the outer tube;

wherein the inner anchor element comprises a tubular body having a first end, a second end, and a plurality of apertures extending radially therethrough;

wherein the each end of the inner anchor element comprises a plurality of circumferentially-spaced protrusions and a pluralitv of circumferentially-spaced recesses, wherein one recess is disposed between each pair of circumferentially adjacent protrusions.

15. The stator of claim 14, wherein the inner anchor element comprises a plurality of circumferentially-adjacent arcuate sections.

16. The stator of claim 15 wherein the inner anchor element has an outer surface comprising a series of axially spaced annular ribs that engage the outer tube.

17. A stator for a progressive cavity pump or motor, comprising:

a stator housing; and a stator thread disposed within the housing, wherein the stator housing further comprises, an outer tube;

an inner anchor element disposed within the outer tube and provided with a plurality of apertures extending extending radially therethrough; and a first end cap fixed to a first end of the outer tube and engaging a first end of the inner anchor element a second end cap fixed to a second end of the outer tube and engaging a second end of the inner anchor element;

wherein each end cap has an inner surface comprising a circumferential dovetail groove that receives a portion of the stator thread.

18. The stator of claim 17, wherein each end cap comprises a tubular body including said circumferential dovetail groove.

19. The stator of claim 5, wherein each inner anchor element arcuate section is the same.

* * * * *